United States Patent [19]

Lohner

[11] 4,027,603

[45] June 7, 1977

[54] REFUSE INCINERATOR

[76] Inventor: Jacques Lohner, 17, avenue de Chailly, 1012 Lausanne, Switzerland

[22] Filed: Jan. 15, 1976

[21] Appl. No.: 649,233

[30] Foreign Application Priority Data

Jan. 21, 1975 Switzerland ..... 696/75

[52] U.S. Cl. ..... 110/18 R; 110/75 R

[51] Int. Cl.² ..... F23G 5/00; F23L 1/00; F23L 9/02

[58] Field of Search ..... 110/75 C, 75 R, 18 R, 110/18 C, 8 R, 8 C

[56] References Cited

UNITED STATES PATENTS

| | | | |
|---|---|---|---|
| 1,607,312 | 11/1926 | Schierenbeck | 110/75 |
| 2,715,881 | 8/1955 | O'Neil | 110/18 |
| 3,203,377 | 8/1965 | Claassen et al. | 110/18 |
| 3,869,994 | 3/1975 | Berlichingen | 110/75 |
| 3,871,286 | 3/1975 | Henriksen | 110/8 |

*Primary Examiner*—Kenneth W. Sprague
*Attorney, Agent, or Firm*—Robert E. Burns; Emmanuel J. Lobato; Bruce L. Adams

[57] ABSTRACT

A refuse incinerator has a grate surmounted by an enclosed generally vertical combustion chamber terminating with a chimney. Several internal pipes deliver streams of primary air to several levels in the lower part of the chamber for combustion of the refuse, and tangential and radial streams of heated secondary air at several levels in the upper part of the chamber for combustion of the rising gases. Additional pipes of inverted U form, extending over the entire height of the chamber and having an inlet end of greater section than the outlet end, deliver heated primary air in the proximity of the grate, which enables relatively humid refuse to be satisfactorily incinerated without auxiliary burners.

4 Claims, 4 Drawing Figures

REFUSE INCINERATOR

BACKGROUND OF THE INVENTION

The invention relates to refuse incinerators.

A known refuse incinerator, described in Applicant's Swiss Patent No. 540,463, comprises a grate surmounted by an enclosed generally vertical combustion chamber terminating with a chimney. In its lower part, the combustion chamber has at least one primary air inlet and at least one secondary air inlet. Means, in the form of pipes, are provided for delivering primary air at several levels into the lower part of the combustion chamber and for delivering preheated secondary air at several levels into the upper part of the combustion chamber. The primary air thus passes through and promotes the burning of refuse piled in the combustion chamber, whereas the secondary air serves to promote combustion of the gases produced by combustion of the refuse.

Such incinerators have been found to give a very satisfactory result for the incineration of dry refuse, or only slightly damp refuse. However, the performance with household refuse having a water content of 60 to 70% by weight has been unsatisfactory, This is because the quantity of heat required to evaporate the moisture is so great that it reduces the temperature of the combustion gases whereby the draught in the chimney becomes insufficient to maintain self-combustion of the refuse. Moreover, a greater quantity of primary air is required to ensure combustion, and the non-combustible nitrogen of this air contributes to cooling of the refuse and the combustion gases. As a result, the combustion is incomplete and smelly, polluting gases with a high carbon monoxide content are given off. To satisfactorily burn such household refuse, it has thus been necessary to furnish the incinerators with expedients such as auxiliary burners and mechanical ventilation devices.

An aim of the invention is to provide an incinerator of the type mentioned above in which humid household refuse can be satisfatorily incinerated by self-combustion without a need for auxiliary burners.

SUMMARY OF THE INVENTION

According to the invention, an incinerator of the mentioned type is characterised in that it comprises at least one elongate pipe or conduit extending in the combustion chamber from an air inlet in the lower part of the combustion chamber, said pipe or conduit having an open outlet end in the proxmity of said grate for the delivery of preheated primary air.

BRIEF DESCRIPTION OF THE DRAWINGS

An embodiment of the invention in shown, by way of example, in the accompanying drawings, in which.

DESCRIPTION OF THE PREFERRED EMBODIMENT

Figure 1:
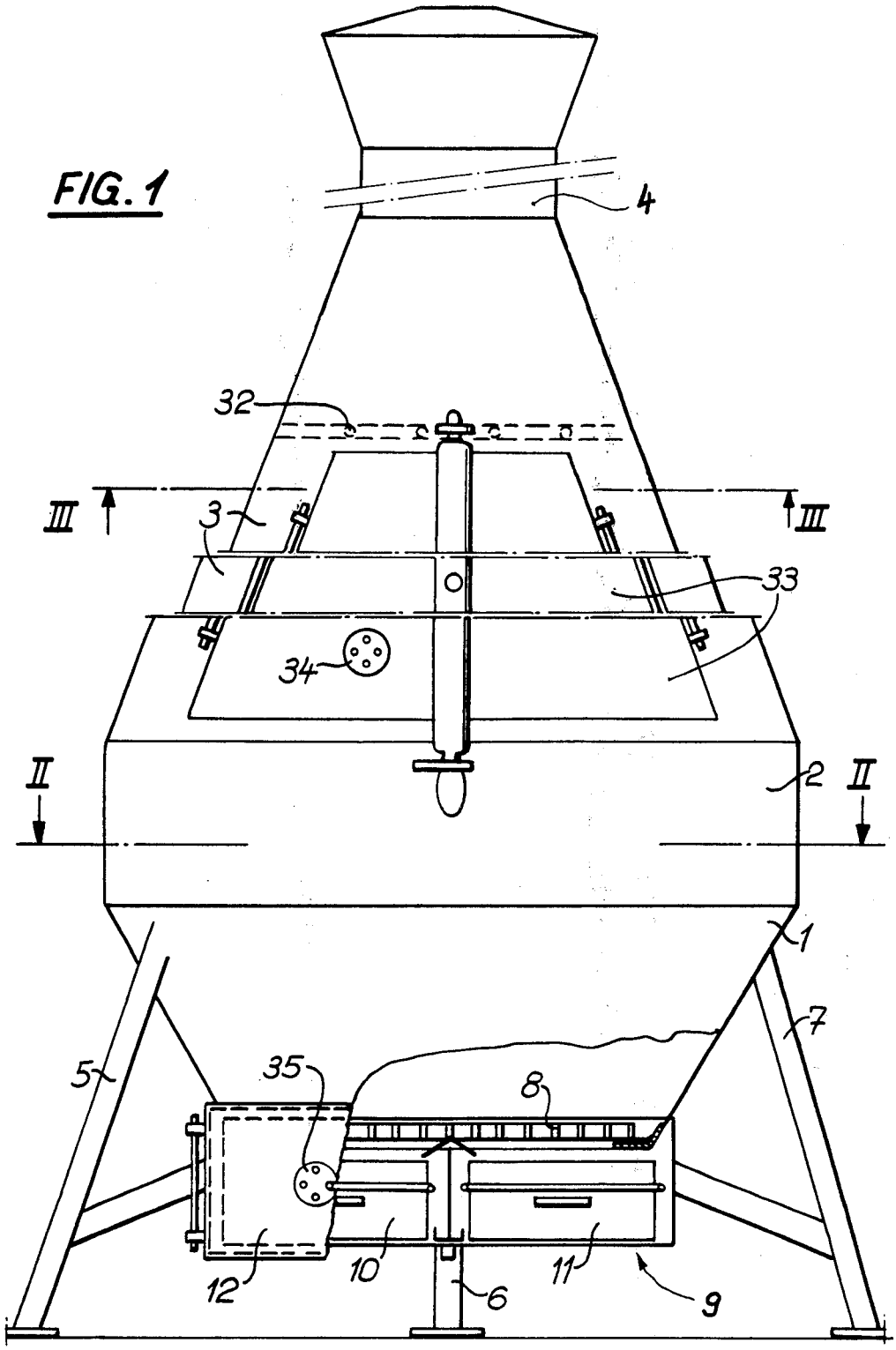
FIG. 1 is a partly cut-way elevational view of the incinerator, omitting various internal pipes and their inlets and outlets.
Figure 2:
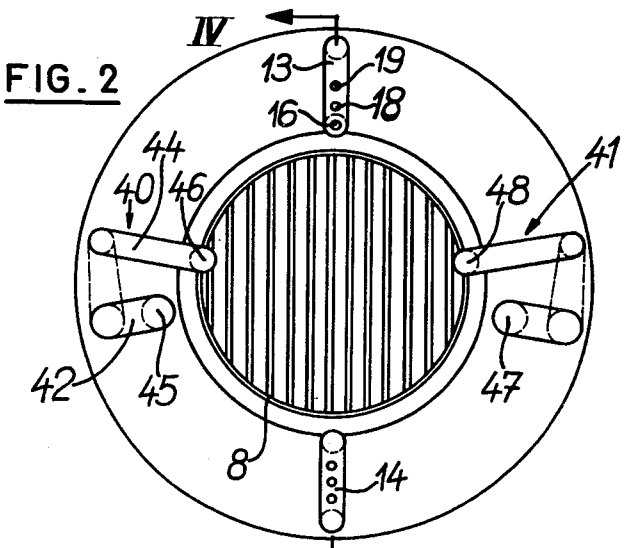
FIG. 2 is a transverse cross-section along lines II—II of FIGS. 1 and 4, on a smaller scale than FIG. 1.

The incinerator shown in the drawings comprises a combustion chamber having a lower upwardly-outflaring trunco-conical part 1, an intermediate cylindrical part 2 and a tapered upper trunco-conical part 3 terminating with a chimney 4 with a steel inner wall 4*a*. The chimney 4 is capped by a Venturi-effect ejection funnel 50. The combustion chamber is supported on three legs 5, 6, 7 and carries, below a grate 8 at the bottom of part 1, a rectangular box 9 for collecting cinders. The box 9 houses two cinder trays 10 and 11 and is closed by a door 12. Means are provided for manually shaking the grate 8 to cause cinders to drop into the box 9.

Figure 4:
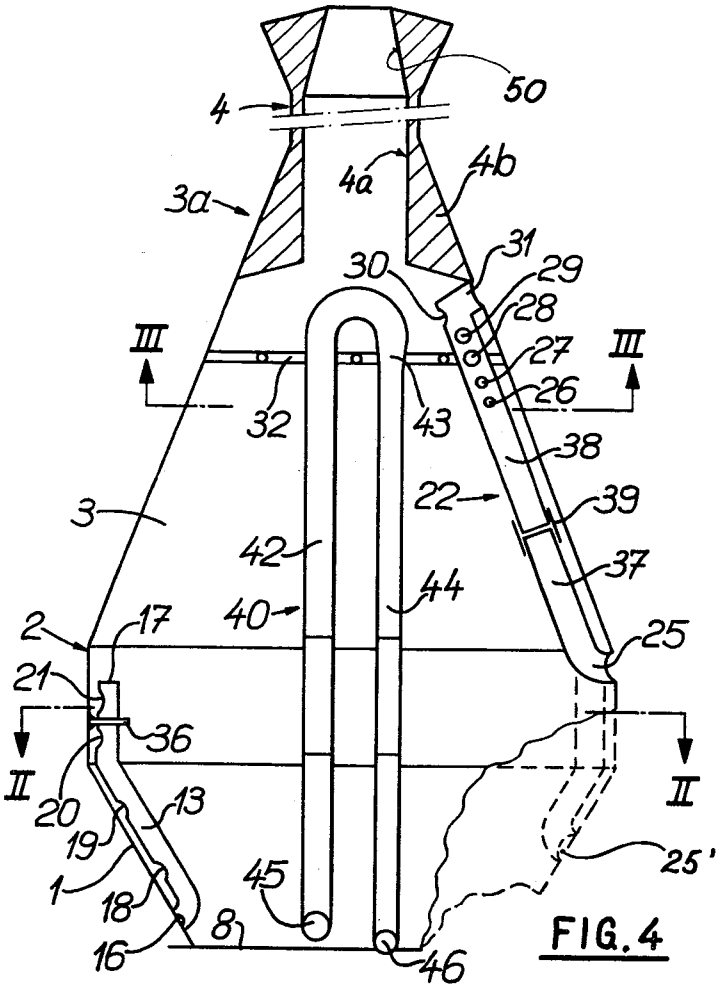
FIG. 4 is a simplified partial axial cross-section along line IV—IV of FIGS. 2 and 3.

The incinerator comprises two identical pipes 13 and 14 for supplying primary air to several levels of the lower part of the combustion chamber. The lower ends of these pipes have air inlets 16 near the bottom of part 1 and are secured near their upper ends to the inside wall surface of the cylindrical part 2, as shown in FIG. 4, by brackets 36. These pipes each have a closed upper end 17 and four outwardly-facing openings 18, 19, 20, 21 at different levels for the supply of primary air.

Figure 3:
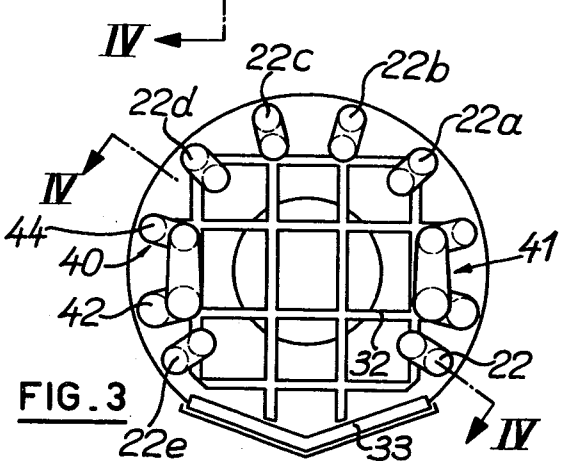
FIG. 3 is a transverse cross-section along lines III—III of FIGS. 1 and 4 on a smaller scale than FIG. 1.

The supply of secondary air to the incinerator is by six identical pipes 22, 22*a*, 22*b*, 22*c*, and 22*e* whose major parts extend parallel to generatrices of the cone of part 3 and are spaced around the combustion chamber as shown in FIG. 3. Only one of these pipes, 22, is shown in FIG. 4, for the sake of simplification. Each of these pipes is secured by its lower and upper ends to the combustion chamber, the lower end being shown in full lines as forming an air-inlet 25 in part 2 just above the level of pipes 13, 14, and the upper end providing an air outlet opening 31 just below chimney 4.

It has been found that the performance may be improved by placing the inlet ends of the pipes, communicating with the outside of the incinerator as shown, in the lower conical part below the cylindrical part 2, as indicated in dotted lines and designated by 25' in FIG. 4

Each of the secondary-air pipes has, near its upper end, four openings 26 to 29 at four different levels. Opening 27 is larger than opening 26, and openings 28 and 29 are both larger than opening 27, all of these openings being directed generally tangential to the trunco-conical part 3. Above these openings, facing radially inwardly away from the opening 31, is a further opening 30. As also shown in FIG. 4, each secondary-air pipe comprises a lower section 37 and, connected thereto by a fitting 39, an upper section 38.

Approximately mid-way between the level of openings 26 and 30 is a fixed horizontal grid 32 with large openings. Grid 32 serves as a baffle creating turbulence in the rising gas stream to improve mixing thereof with the heated secondary air and, consequently, to improve combustion.

On the part 3, the incinerator has a double door 33 for loading refuse into the combustion chamber. The door 33 has a rotary perforated disc 34 for fine adjustment of the secondary air, in a known manner. A similar disc 35 is provided on the door 12 for adjustment of the primary air.

The incinerator further comprises a device for supplying preheated primary air, formed by two tubes 40, 41 extending over practically the entire height of the combustion chamber. Tube 40 has a first part 42 extending upwardly from an air inlet 45 situated approximately at the same level as inlet 16. At its upper end, above grid 32, this part 46 is recurvate and is connected by a tapering portion 43 to a downwardly-extending part 44 of lesser section than part 42. Part 44 extends down to an outlet 46 situated just above the grid 8. The tube 40 is thus generally in the configuration of an inverted U extending over a major part of the height of the combustion chamber. The tube 41 is disposed symmetrically to tubes 40, on one of two the opposite sides of the combustion chamber, is of similar form to tube 40, and has an air inlet 47 and an outlet 48. The outlet 48 may be at the same level as outlet 46, but could be at a different level, for example at mid-height or another intermediate level in the combustion chamber, above the grate 8 as indicated at 46*a*.

The described primary and secondary air delivery arrangements produce the following effects:

By the described and illustrated disposition of openings 18, 19, 20 and 21, the pipes 13 and 14 supply primary air at four levels so that the refuse in the combustion chamber regularly receives primary air, substantially independently of the quantity of refuse in the incinerator. The incinerator is full when the refuse reaches the upper part of doors 33, i.e. close to the grid 32. The upper inner part 3*a* of the trunco-conical part 3 situated above grid 32 is solely a secondary combustion chamber for the gases produced by combustion of the refuse in the lower part.

During combustion, the pipes 22 to 22*e* heat up and suck in a rising current of air via the inlets 25. As a result of the depression (or reduction of air and gas pressure) naturally produced by the draught in the chimney, the heated secondary air is sucked, approximately tangentially, into the combustion chamber at the four levels of openings 26 to 29. The trunco-conical wall of the combustion chamber imparts a cyclonic movement to the resulting secondary air streams about the axis of the incinerator. Part of the secondary air is also delivered radially via openings 30. The cyclonic secondary air stream has a purifying effect, as it drives light particles in the rising gases against the wall of the incinerator, where these particles stick. They may drop to the bottom of the incinerator when they cool down.

The pipes 40 and 41 supplying preheated primary air enable the combustion of humid household refuse by supplying a large quantity of carburising air, at high temperature to the lower part of the incinerator. The difference of section between parts 42 and 44 creates additional depression in the inlet part 42, hence improving the intake of air.

To ensure starting up of combustion, it is preferable to initially place dry refuse on the grate and on top of the heaped household refuse.

The height of the chimney is arranged so that the draught is neither too great nor too small and so that the supply of secondary air is also maintained within certain limits. An over-great supply of secondary air would tend to reduce the draught in the chimney or even produce a back-flow, whereas an insufficient supply would increase the draught and allow unburnt gases and light particles to pass out of the chimney. To avoid an excess of secondary air, a part of the secondary air is allowed to escape via openings 31. Moreover, about its wall 4*a*, the chimney 4 is insulated by material 4*b* to keep the chimney hot at the end of operation so as to maintain the draught until combustion has completely terminated.

The openings 31 also have a favorable effect during lighting up since they allow an intake of air through openings 31 and down the pipes 22 to 22*e* into the combustion chamber via openings 29 to 26. This occurs during several seconds until the heating of pipes 22 to 22*e* provides an intake of secondary air via inlets 25 and ensures a delivery of heated secondary air to promote combustion.

To regulate the primary and secondary air, the discs 34 and 35 are firstly closed, then opened to a greater or lesser degree as need be.

Of course the invention in its broad aspects is not limited to the described embodiment which has been chosen for its good aesthetic appearance and ease of manufacture. It is for example possible to increase the number of recurvate pipes such as 40 and 41 to increase the production of heated primary air. In this case, some or all of the heated secondary air pipes may be replaced by external flues or sheathing to allow space in the combustion chamber to accomodate the extra recurvate primary air pipes.

What is claimed is:

1. A refuse incinerator, comprising;

means defining an enclosed, generally vertical combustion chamber, having a grate in a bottom part thereof, and a chimney in a top portion of the chamber;

means for delivering primary air into a lower part of the combustion chamber at several levels of the lower part;

means for delivering preheated secondary air into an upper part of the combustion chamber at several levels of the upper part; and an elongate conduit extending in the combustion chamber, having an air inlet in the lower part of the combustion chamber and having an outlet in the proximity of the grate for delivering preheated primary air to the lower part of the combustion chamber and for thereby promoting incineration, including the incineration of humid refuse.

2. An incinerator according to claim 1, in which the conduit for delivering preheated primary air comprises a first part extending upwardly from the conduit's air inlet and a second part extending downwardly to the conduit's outlet end, said second part being of smaller cross section than said first part.

3. An incinerator according to claim 2, in which the conduit is of generally inverted U-shaped and extends over a major vertical part of the combustion chamber.

4. An incinerator according to claim 3, comprising a further conduit of generally inverted U-shape for delivering preheated primary air, said further conduit being generally similar to the first-mentioned elongate conduit but having an outlet disposed in the combustion chamber at a level above the grate and between the top and bottom of the chamber.

* * * * *

UNITED STATES PATENT AND TRADEMARK OFFICE

CERTIFICATE OF CORRECTION

PATENT NO. : 4,027,603
DATED : June 17, 1977
INVENTOR(S) : LOHNER

It is certified that error appears in the above-identified patent and that said Letters Patent are hereby corrected as shown below:

In column 3, line 3 of the patent, the numeral "46" should read --42--.

Signed and Sealed this

*Twenty-eighth* Day of *February 1978*

[SEAL]

*Attest:*

RUTH C. MASON
*Attesting Officer*

LUTRELLE F. PARKER
*Acting Commissioner of Patents and Trademarks*